United States Patent [19]

Horsch et al.

[11] Patent Number: 4,828,044

[45] Date of Patent: May 9, 1989

[54] DOZER BLADE MOUNTING ASSEMBLY

[75] Inventors: Rudolf Horsch, Wausau; Claude M. Frisbee, Schofield, both of Wis.

[73] Assignee: J. I. Case Company, Racine, Wis.

[21] Appl. No.: 83,533

[22] Filed: Aug. 7, 1987

[51] Int. Cl.[4] ..... E02F 3/815

[52] U.S. Cl. ..... 172/821; 172/824

[58] Field of Search ..... 172/818–827

[56] References Cited

U.S. PATENT DOCUMENTS

| | | | |
|---|---|---|---|
| 2,749,630 | 6/1956 | Nave | 37/144 |
| 3,529,678 | 9/1970 | Teasdale | 172/821 |
| 3,631,930 | 1/1972 | Peterson | 172/821 |
| 3,991,832 | 11/1976 | Cooper | 172/821 |
| 4,081,036 | 3/1978 | Yokoyama | 172/821 |
| 4,083,414 | 4/1978 | Yokoyama et al. | 172/821 |
| 4,201,268 | 5/1980 | Frisbee | 172/821 |
| 4,270,617 | 6/1981 | Cantarella | 172/821 |
| 4,281,721 | 8/1981 | Beales | 172/821 |
| 4,364,439 | 12/1982 | Asal | 172/821 |
| 4,424,871 | 1/1984 | Stickney | 172/821 |
| 4,562,891 | 1/1986 | Ranner | 172/821 |
| 4,638,869 | 1/1987 | Murphy et al. | 172/821 |

FOREIGN PATENT DOCUMENTS 1115515 1/1982 Canada .

*Primary Examiner*—Richard J. Johnson

*Attorney, Agent, or Firm*—Ralph T. Rader

[57] ABSTRACT

A dozer blade mounting assembly for angling and tilting the blade, while preventing pitching, without inducing stresses in the assembly. The blade is supported on a conventional C-frame by a universal connection in the longitudinal axis of the vehicle. The mounting assembly includes a mast assembly connected to the frame mid-portion and extending upwardly from the frame, a pair of hydraulic angling cylinders connected between the side portions of the blade and the mast assembly adjacent the longitudinal axis of the vehicle, a tilt cylinder connected between the frame and the mast assembly and a bracket assembly supporting the upper portion of the blade and preventing pitching of the blade. The bracket assembly includes a bracket member having an elongated slot extending generally parallel to the blade and a slide block having a width substantially equal to the width of the slot which floats within the slot to allow tilting of the blade, but preventing pitch of the blade.

2 Claims, 5 Drawing Sheets

Fig-6
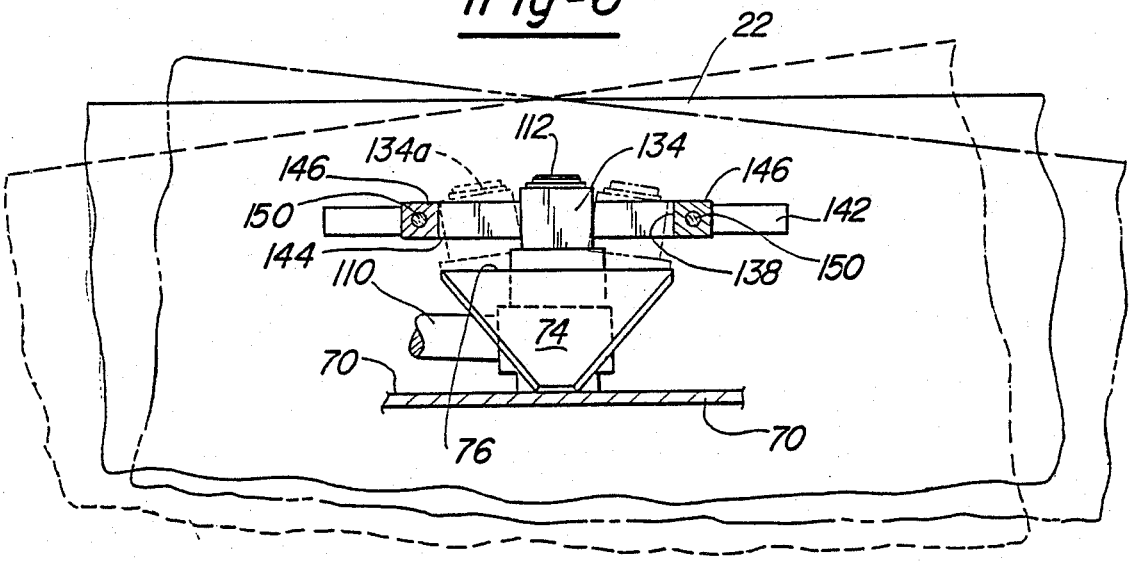
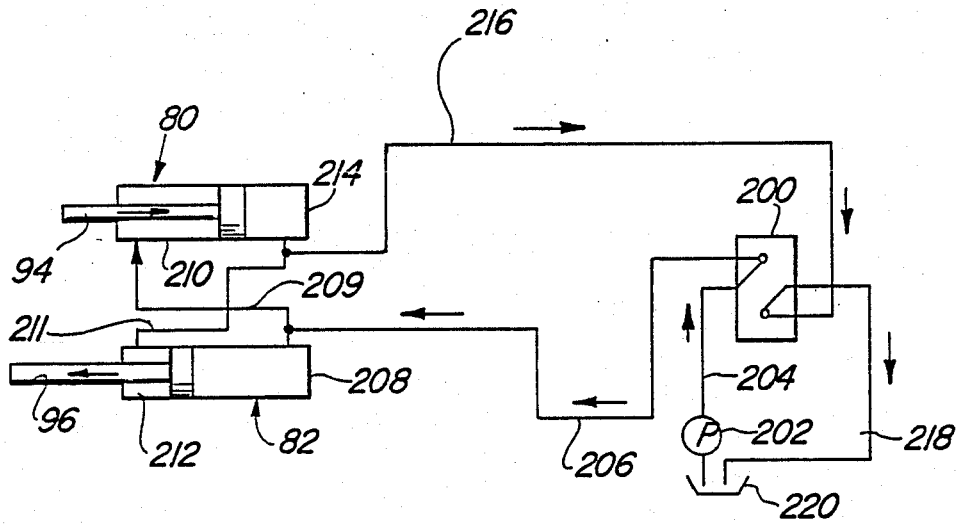
Fig-7

DOZER BLADE MOUNTING ASSEMBLY

FIELD OF THE INVENTION

This invention relates to a dozer blade mounting assembly for angling and tilting the dozer blade while preventing pitch of the blade and avoiding damaging stresses in the mounting assembly.

BACKGROUND ART

Several prior patents are concerned with either eliminating or controlling the pitch of a dozer blade about the universal connection to the C-frame to avoid damaging stresses in the mounting assembly or high pressures in the angling cylinders. The prior proposed solutions to this problem have included complex relief circuitry, such as disclosed in U.S. Pat. No. 3,991,832, or complex linkages or blade support arrangements, such as disclosed in U.S. Pat. Nos. 4,083,414 and 4,424,871 and Canadian Pat. No. 1,115,514. These arrangements have not, however, proven commercially satisfactory for controlling or preventing pitch of the blade and the mounting arrangements disclosed therein are generally too complex for practical application.

Reference is also made to U.S. Pat. No. 4,201,268 of Claude M. Frisbee assigned to the assignee of the present application. This patent discloses the general arrangement of the preferred embodiment of the blade mounting assembly of this invention, but fails to recognize the need to control or prevent pitching of the dozer blade. With the arrangement disclosed in the Frisbee patent, it was possible to pitch the blade forwardly sufficiently to cause failure of the angle-pitch piston cylinders. Further, the pitch of the blade may change slowly under a constant load due to leakage in the hydraulic circuit. These problems have been eliminated by the dozer blade mounting assembly of this invention which prevents any pitching of the blade.

SUMMARY OF THE INVENTION

The dozer blade mounting assembly of this invention preferably includes a conventional C-frame, wherein the blade is supported on a universal connection in the axis of the tractive vehicle. A mast assembly is connected to the midportion of the frame which extends upwardly from the frame adjacent the blade center axis. The assembly includes a pair of angling cylinders each having one end connected to a side of the blade and the opposed end is connected to the mast assembly in close proximity to the longitudinal axis of the vehicle. The mounting assembly further includes a tilt cylinder having one end connected to a side of the blade and the opposed end connected to the mast assembly.

Pitching of the dozer blade is prevented in the blade mounting assembly of this invention by a bracket assembly interconnecting the mast assembly and the blade which also supports the top portion of the blade. The bracket assembly includes a first bracket member, preferably attached to the blade, having an elongated slot extending generally parallel to the blade, and a second bracket member, preferably part of the mast assembly, having a slide member rotatably supported on the second bracket member disposed in the first bracket member slot. The slide member has a width which is substantially equal to the width of the slot, preventing pitching of the blade, and a length which is substantially less than the length of the slot, permitting tilting of the blade.

In the most preferred embodiment of the assembly, the slide member is rotatably supported on a shaft which is rigidly supported on the frame in the vertical axis of the universal connection of the blade to the C-frame. The front and back surfaces of the slot are defined by parallel bearing faces and the slide member is a slide block having parallel side faces closely received by the bearing faces of the slot. The tilt cylinder is preferably pivotally connected to the shaft of the bracket assembly, providing a compact reliable assembly, wherein the blade may be angled and tilted about the vertical and horizontal axes of the universal connection while avoiding damaging stresses in the mounting assembly because of the described geometry of the assembly.

Other advantages and meritorious features of the present invention will be more fully understood from the following description of the preferred embodiments, the appended claims and the drawings, a brief description of which follows.

BRIEF DESCRIPTION OF THE DRAWINGS

FIG. 6 is a partial back view of the frame assembly showing the relative motion of the blade;

FIGS. 7 and 8 are schematic illustrations of the hydraulic angling circuit of one embodiment of the present invention with associated hydraulic components;

DESCRIPTION OF THE PREFERRED EMBODIMENT

Figure 1:
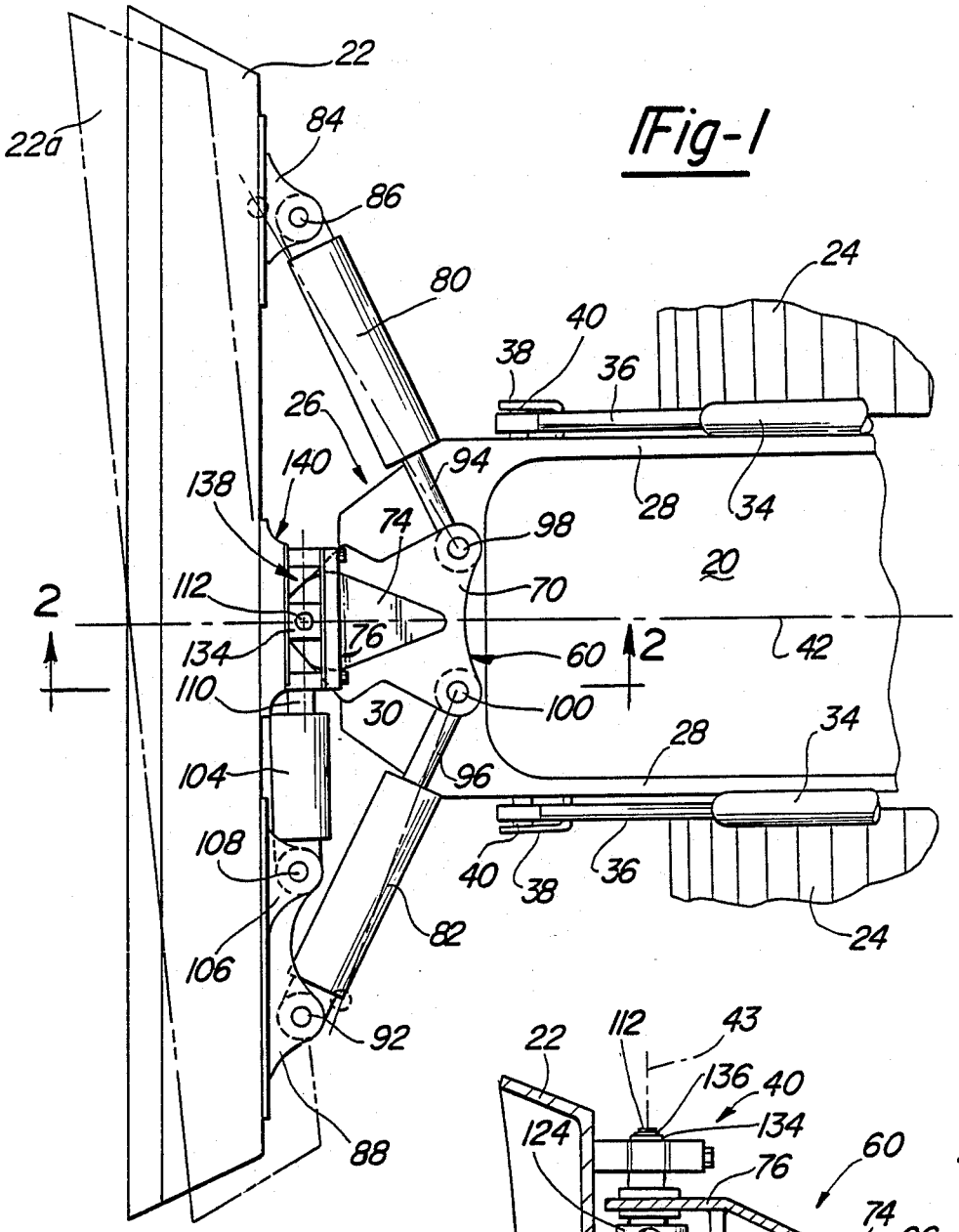
FIG. 1 is a top view of a bulldozer including one embodiment of the blade mounting assembly of this invention.

FIG. 1 illustrates one embodiment of the dozer blade mounting assembly of this invention on a conventional bulldozer 20, wherein the dozer blade 22 is supported at the forward end of the bulldozer. The disclosed embodiment of the bulldozer 20 has conventional continuous tracks 24 for tractive movement. It will be understood, however, that the blade mounting assembly of the present invention may be used with other tractive vehicles, including rubber tired vehicles. The disclosed embodiment of the blade mounting assembly includes a conventional C-frame 26 including side portions 28 which extend along the sides of the bulldozer between the body and the tracks 24 and a midportion 30 which extends across the forward end of the dozer. It will be understood, however, that the blade mounting assembly of this invention may slo be used with an "outside" C-frame, wherein the side portions of the C-frame are located outside the bulldozer tracks. The ends of the C-frame side portions 28 are pivotally supported on the chassis of the bulldozer (not shown) for raising and lowering the forward end 30 of the frame and the supported dozer blade 22.

Figure 2:
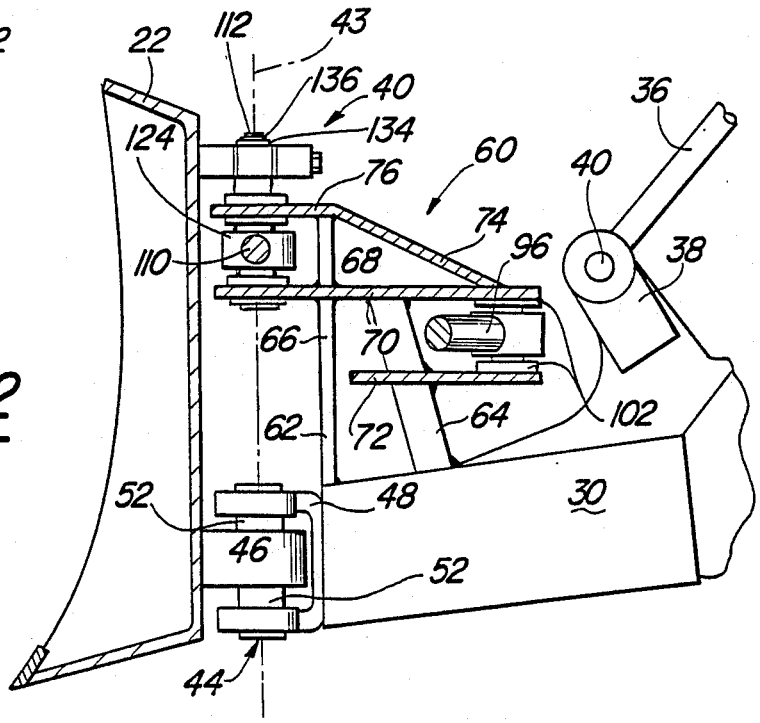
FIG. 2 is a partial side cross-sectional view of the embodiment of the invention shown in FIG. 1, in the direction of view arrows 2—2.
Figure 3:
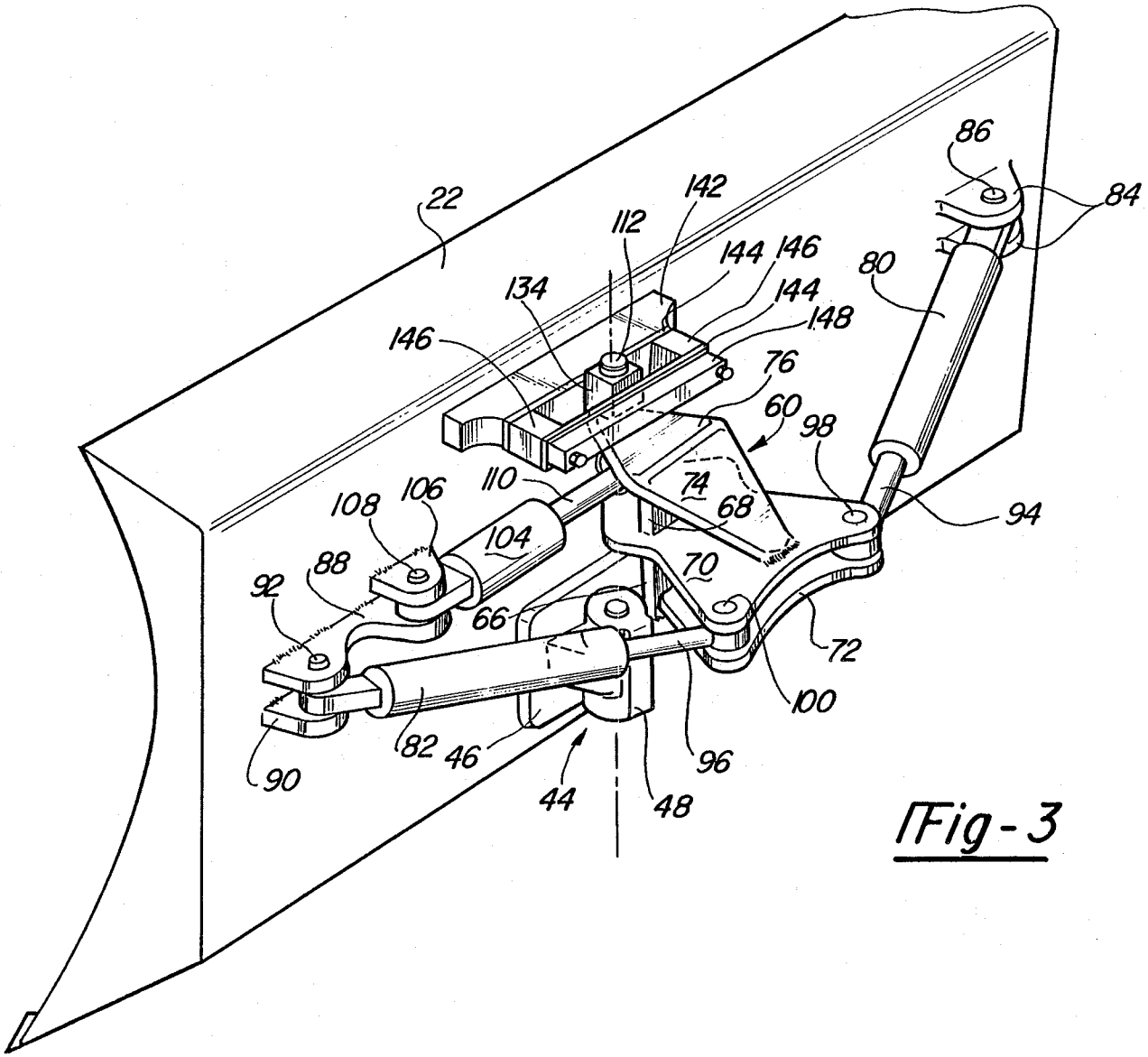
FIG. 3 is a rear elevation perspective view of the dozer blade mounting assembly shown in FIGS. 1 and 2.

In the disclosed embodiment, the forward end 30 of the frame 26 is raised and lowered by lift cylinders 34. Each of the lift cylinders is supported on a conventional trunion mounting (not shown) and the cylinders each include a rod portion 36 which is pivotally attached to a bracket 38 on the side of the frame by a pivot pin 40, as best shown in FIG. 2. The lower center or midportion of the blade 22 is supported on the midportion 30 of the frame by ball joint, as shown in FIGS. 2 and 3, which is located in the longitudinal axis 42 of the vehicle shown in FIG. 1. In the disclosed embodiment, the ball joint assembly includes a bracket 46, which is welded or otherwise secured to the lower midportion of the blade, a clevis 48, which is welded or otherwise secured to the center of the midportion 30 of the frame and a ball member (not shown) having rod portions 52 secured within the ends of the clevis 48. The ball joint 44 is a conventional ball joint and the specific design does not form a part of the present invention.

As described, the preferred embodiment of the blade mounting assembly of this invention includes a mast assembly 60 for supporting the upper portion of the blade and for preventing pitch of the blade. In the disclosed embodiment, the mast assembly 60 is a welded plate construction including vertical support plates 62 to 68, bracket plates 70 and 72 which pivotally support the angling cylinders, as described below, reinforcement plate 74 and bracket plate 76. The disclosed embodiment of the mast assembly 60 is therefore relatively simple in construction and provides a strong support for the angling and tilt cylinders and the bracket assembly, described below.

The hydraulic angling cylinders 80 and 82 are attached at one end to the sides of the blade 22 and the opposed ends are preferably attached to the mast assembly 60 in close proximity to the longitudinal axis 42 of the vehicle, as best shown in FIG. 1. In the disclosed embodiment, the head end of the right hand angling cylinder 80 is connected to bracket ears 84 welded or otherwise secured to the side of the blade 22 by pivot pin 86. The head end of the left hand angling cylinder 82 is pivotally attached to bracket ears 88, 90 by pivot pin 92. The rod end 94 of the right hand angling cylinder 80 is attached by pivot pin 98 to ear portion of bracket plates 70, 72 by pivot pin 98. The rod portion 98 of the left hand cylinder 82 is attached to the ear portions of bracket plates 70, 72 by pivot pin 100. As best shown in FIG. 2, the rod end of the angling cylinders are supported on bearing rings 102.

Figure 4:
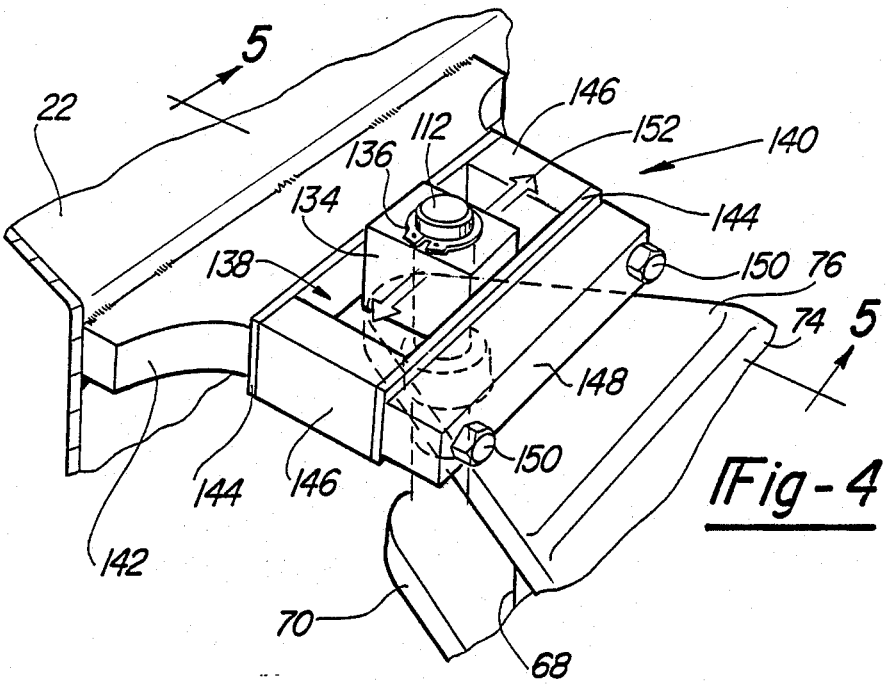
FIG. 4 is a partial cross-sectional view of the pitch limiting frame assembly.
Figure 5:
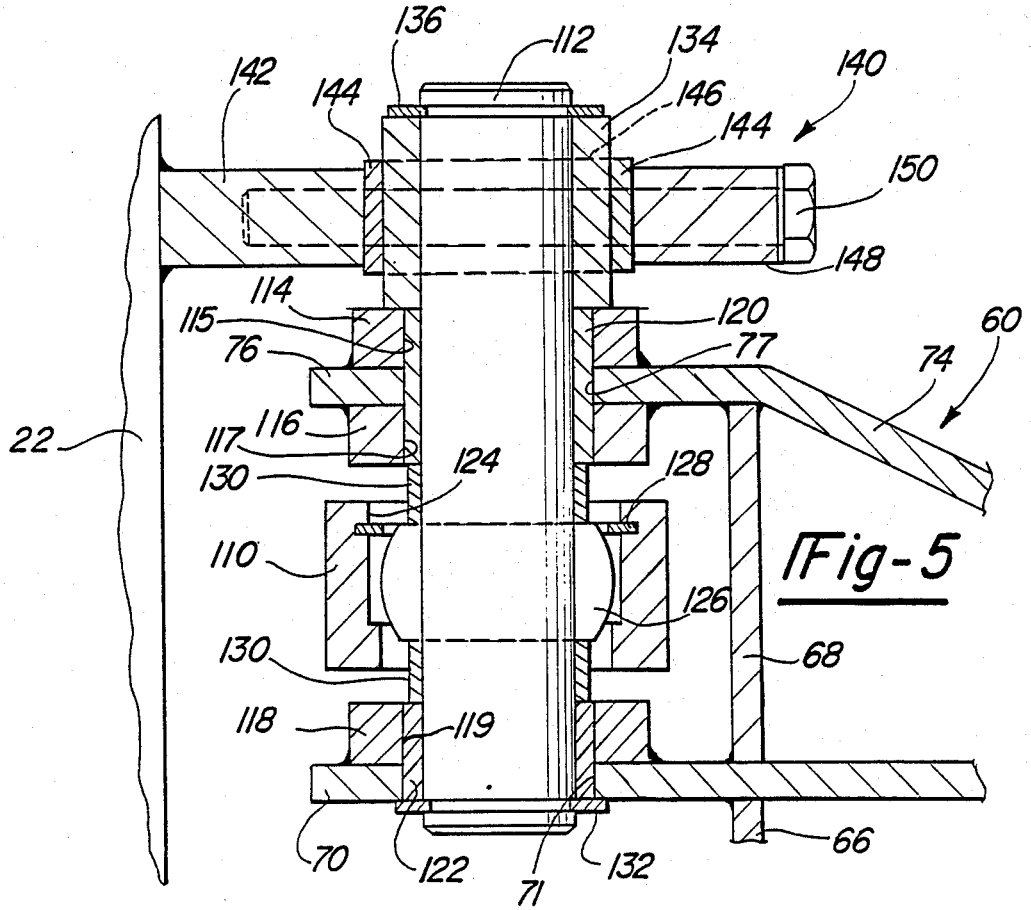
FIG. 5 is a cross-sectional view of FIG. 4, in the direction of view arrows 4—4.

The tilt cylinder 104 is operably connected between one side of the dozer blade 22 and the frame assembly 60 to tilt the blade, as described below. In the preferred embodiment, the head end of the tilt cylinder is connected to bracket ear 106 and bracket 88 by pivot pin 108, as best shown in FIG. 3. The rod end 110 of the tilt cylinder 104 is connected to a vertical shaft 112 of the bracket assembly, which is a primary component of the pitch preventing bracket assembly described below. The shaft 112 is rigidly supported on the mast assembly, as best shown in FIGS. 4 and 5. Referring now to FIG. 5, the shaft 112 is rigidly supported between plates 70 and 76 of the mast assembly. Support blocks 114 and 116 are welded or otherwise secured to opposed sides of bracket plate 76 and support block 118 is welded to the top of bracket plate 70. The support blocks 114, 116 and 118 have cylindrical coaxially aligned openings 115, 117 and 119, respectively, and the plates 70 and 76 have coaxially aligned openings 71 and 77, respectively, which receive bearing sleeves 120 and 122. The shaft 112 is received in the bearing sleeves for rigid support in bracket plates 70 and 76. As shown, the eye 124 of tilt cylinder piston rod 110 is universally supported on a ball member 126 by snap ring 128 and the ball member 126 is retained on the shaft by spacer bearing members 130. The lower end of the shaft 112 is retained by snap or retainer ring 132.

In the preferred embodiment of the upper bracket assembly, a slide block member 134 is rotatably supported on shaft 112 by snap ring 136. The slide block is received in a slot 138 in bracket member assembly 140 which is attached to the back of the blade 22 adjacent its upper edge, as best shown in FIG. 4. The bracket member assembly 140 includes a bracket plate 142 which is welded or otherwise attached to the back of the blade. The slot 138 is defined by opposed parallel bearing plates 144 and spacer blocks 146. The assembly is attached to bracket plate 142 by retainer block 148 which is bolted to plate 142 by bolts 150, as shown in FIGS. 4 and 5.

Having described the components, the function of the bracket assembly and dozer blade mounting assembly of this invention may now be explained. The dozer blade 22 may be angled about the vertical axis of the lower ball joint 44 by extending one angling cylinder and retracting the other angling cylinder. For example, the blade may be angled to the left as shown in phantom at 22a in FIG. 1 by extending right hand angling cylinder 80 and retracting left hand cylinder 82. The upper portion of the blade is supported by the bracket assembly, wherein the shaft 112 is coaxially aligned with the ball joint 44 as shown by line 43 in FIG. 2. Thus, during angling, the blade rotates about vertical axis 43 and the slide block 134 rotates about shaft 112 which is attached to the mast assembly 60, as shown in FIG. 5. Thus, the upper and lower portions of the blade 22 are fully supported during angling. The blade may be tilted by extending or retracting tilt cylinder 104. During tilting of the blade 22, the slide block member 134 moves laterally in the slot 138 as shown by arrows 152 in FIG. 4 and in phantom at 134a in FIG. 6. As shown particularly in FIG. 6, the slide block member "floats" in slot 138 to permit the blade to be angled. As shown, the width of slot 138, which is defined by the distance between bearing plates 144, is substantially equal to the width of slide block member 134, preventing any pitching of the blade 22. The length of the slot 138, which is defined as the distance between spacer blocks 146, is substantially greater than the length of the slide block 134, permitting tilting of the blade.

As described in the background art supra, the prior patented art teaches that complex hydraulic relief circuitry or blade mounting arrangements are required to avoid damaging stresses in the mounting assembly or pressure build-up in the hydraulic controls if the blade is prevented from pitching during angling and tilting. These problems are avoided in the blade mounting and bracket assembly of this invention by the geometry of the assembly, wherein the angling cylinders 80, 82 are pivotally attached to the ear portions of the mast assembly 60 in close proximity to the longitudinal axis 42 of the tractive vehicle with the angling cylinders extending outwardly at a relatively large angle to the longitudinal axis 42 and the shaft 112 coaxially aligned with the vertical axis 43 of ball joint 44. In the disclosed embodiment, the angling cylinders extend at an angle of about 60 to 70 degrees to the longitudinal axis 42 of the tractive vehicle. In actual testing of the mounting assembly shown in FIGS. 1 to 6, no adverse stresses were found in the assembly during angling and tilting of the dozer blade. Further, the upper portion of the blade is fully supported in all positions of the blade, providing a more reliable assembly. Finally, the hydraulic control circuit for the mounting assembly may be relatively simple, as shown in FIGS. 7 to 10.

Figure 8:
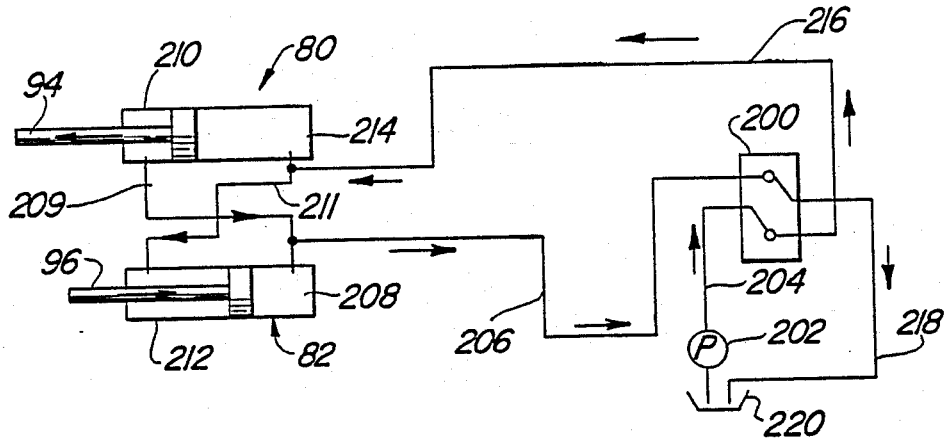

FIGS. 7 and 8 illustrate the hydraulic circuit for angling the blade, wherein one of the angling cylinders 80, 82 is extended and the other angling cylinder is retracted. FIG. 7 illustrates the operation of the circuit when the blade is angled to the right. The hydraulic angling circuit includes a conventional equipment control valve 200, which is an open center spool valve having four ports. Hydraulic fluid is pumped by pump 202 through line 204 to control valve 200 which directs fluid through line 206 to the head end 208 of the left hand angling cylinder 82 and through line 209 to the rod end 210 of right hand angling cylinder 80, thereby extending piston rod 96 and retracting piston rod 94, angling the blade to the right. The hydraulic fluid from the rod end 212 of the left hand cylinder 82 is returned through line 211 and the hydraulic fluid from the head end 214 of the right hand angling cylinder 80 is returned through line 216 to control valve 200. Control valve 200 then directs the hydraulic fluid through discharge line 218 to the reservoir 220. The blade is angled to the left by reversing the flow, as shown in FIG. 8. Hydraulic fluid from pump 202 is pumped through line 204 to equipment control valve 200 which transfers the fluid through line 216 to the head end 214 of the right hand angling cylinder 80 and through line 211 to the head end 212 of the left hand angling cylinder 82. The piston rod 94 of the right hand angling cylinder 80 is thus extended and the piston rod 96 of the left hand cylinder 82 is retracted to angle the blade to the left. The hydraulic fluid from the head end 210 of the right hand angling cylinder 80 is returned through line 209 and the hydraulic fluid from the head end 208 is returned through line 206 to the control valve 200. The hydraulic fluid is then transferred through line 218 to reservoir 220.

Figure 9:
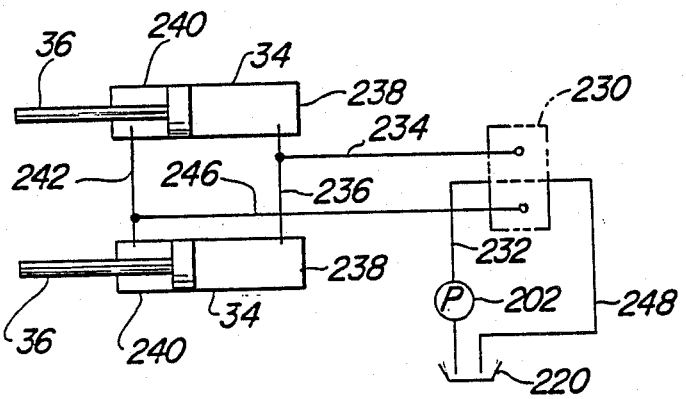
FIG. 9 is a schematic illustration of the hydraulic lift circuit with the associated hydraulic components.

FIG. 9 illustrates schematically the lift circuit which controls the lift cylinders 34. The circuit includes a lift motor control valve 230 which connects the outlet 232 of the pump 202 to either a supply line 234 extending to the head ends 238 of the cylinders 34 so as to extend the piston rods 36 and lower the midportion 30 of the C-frame 26 and lower the dozer blade 22, or to the rod ends 240 of cylinders 34 through supply line 246 to raise the dozer blade 22. To lower the dozer blade, fluid is pumped through line 232 from pump 202 to control valve 230 which transfers the fluid through line 234 and line 236 to the head ends 238 of the lift cylinders 34. The fluid is returned from the rod ends 240 through lines 242 and 246 to the control valve 230, which transfers the fluid through discharge line 248 to the reservoir 220. When the blade is lifted, the flow is reversed. In the neutral setting of lift control valve 230, connection between the lift cylinders 34 and the pump 202 is disrupted. In the so-called float position, the control valve 230 connects both the rod ends and the head ends of the lift cylinders to the discharge line 248 and blocks or cuts off the communication with the pump outlet 232.

Figure 10:
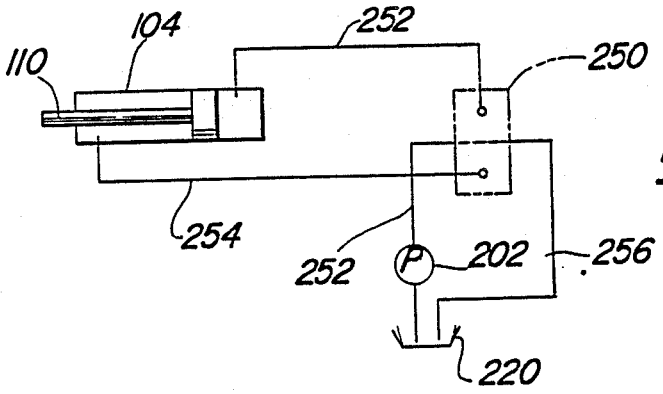
FIG. 10 is a schematic illustration of the hydraulic tilt circuit with the associated hydraulic components.

Referring to FIG. 10, a manually operated tilt control valve 250 is shown connected to the outlet 252 of pump 202. The tilt control valve 250 is adjustable to connect the outlet to either a supply line 252 extending to the head end of the tilt motor 104 or to supply line 254 extending to the rod end of the tilt cylinder 104. The tilt motor control valve 250 can also be moved to its neutral setting to disconnect the supply line 252 from both the pump outlet and the discharge line 256 to reservoir 220. Thus, as piston rod 110 is extended outwardly from the tilt cylinder 104, a downward push will be exerted on the upper edge of the blade 22 nearest to the piston rod and an upward pull is exerted on the lower edge of the blade diagonally positioned therefrom to rotate the blade about the longitudinal axis defined by the universal joint 44, tilting the blade, as described in the above-referenced U.S. Pat. No. 4,201,268.

Thus, the dozer blade and the mounting assembly of this invention may be angled by angling cylinders 80, 82. During angling, the blade is rotated about the vertical axis 43 of the ball joint 44 and the coaxially aligned longitudinal axis of shaft 112 as best shown in FIGS. 1 and 2. The blade is tilted by tilt cylinder 104 about the longitudinal axis of the ball joint 44, parallel to the longitudinal axis 42 of the vehicle. During tilting of the blade, the slide block 134 "floats" in the bracket slot 138 as best shown in FIG. 6. When the blade is tilted and angled, actual stress testing of the mounting arrangement shown in FIGS. 1 to 4 shows that the assembly is not stressed because the pitching force is very small. As will now be understood, the slide block 134 rotates about the axis of shaft 112 during angling of the blade and the slide block slides laterally relative to the bracket assembly 140 and tilts as shown in FIG. 6 to accommodate tilting of the blade.

Various modifications may be made to the mounting assembly of this invention within the purview of the following claims. For example, the mounting assembly may be used with an outside C-frame, wherein the side portions 28 of the frame are located outside the bulldozer tracks 24.

We claim:

1. A mounting assembly supporting a blade on a tractive vehicle, comprising a blade support frame at the forward end of said vehicle, a universal joint interconnecting a lower midportion of said blade and said frame generally in a longitudinal axis of said vehicle, a mast assembly connected to said frame and extending upwardly from said frame adjacent said blade midportion, a pair of hydraulic angling cylinders, each of said angling cylinders having one end pivotally connected to one side of said blade and an opposed end pivotally connected to said mast assembly adjacent said longitudinal axis, said angling cylinders extending outwardly from said mast assembly at an angle to said vehicle longitudinal axis for tilting said blade about said universal joint, a hydraulic tilt cylinder pivotally connected between one side of said blade and said mast assembly for tilting said blade about said universal joint, and a bracket assembly including bracket members connected to an upper midportion of said blade and said mast assembly spaced vertically above said universal joint, one of said bracket members including an elongated slot having generally parallel side surfaces extending generally perpendicular to said vehicle longitudinal axis and the other of said bracket members having a slide member rotatably supported thereon and disposed in said one bracket member slot, said slide member having a width substantially equal to the width of said slot measured perpendicular to said side surfaces preventing pitching of said blade about said universal joint and said slide member having a length substantially less than the length of said slot permitting tilting of said blade;

said one bracket member is attached to said blade adjacent an upper end of said blade and said slide member rotatably supported on a shaft connected to said mast assembly and extending generally perpendicular to said vehicle longitudinal axis, and said one bracket member comprises a first portion attached to said blade adjacent an upper end of said blade and having a first flat bearing surface generally parallel to said blade and a second portion having a second flat bearing surface generally parallel to said first bearing surface in spaced relation and said slide member having flat parallel side surfaces closely received between said bearing surfaces preventing pitching of said blade; and said slide member is rotatably supported on a shaft connected to said mast assembly, and said tilt cylinder is universally connected to said shaft.

2. A mounting assembly supporting a blade on a tractive vehicle, comprising a blade support frame at the forward end of said vehicle, a universal joint interconnecting a lower midportion of said blade and said frame generally in a longitudinal axis of said vehicle, a mast assembly connected to said frame and extending upwardly from said frame adjacent said blade midportion, a pair of hydraulic angling cylinders, each of said angling cylinders having one end pivotally connected to one side of said blade and an opposed end pivotally connected to said mast assembly adjacent said longitudinal axis of said vehicle, said angling cylinders extending outwardly from said mast assembly at an angle to said vehicle longitudinal axis for tilting said blade about said universal joint, a hydraulic tilt cylinder pivotally connected between one side of said blade and said mast assembly for tilting said blade about said universal joint, a first bracket member attached to said blade spaced vertically above said universal joint, said first bracket member having an elongated slot extending generally parallel to said blade, and a second bracket member connected to said mast assembly having a slide block rotatably supported on said mast assembly disposed in said first bracket member slot, said slide block having a widthy substantially equal to the width of said elongated slot preventing pitching of said blade about said universal joint, and said slot having a length substantially greater than the length of said slide block permitting tilting of said blade, said slide block floating in said slot as said blade is angled and tilted about said universal joint by said hydraulic cylinders;

said slot has generally parallel side surfaces extending generally parallel to said blade and said slide block having parallel side surfaces closely received by said slot side surfaces;

said slide block is rotatably supported on a shaft connected to said mast assembly, said shaft extending generally perpendicular to said vehicle longitudinal axis in the axis of said universal joint, and said tilt cylinder is pivotally connected to said shaft; and said first bracket member comprises a first portion attached to said blade adjacent an upper edge of said blade having a first flat bearing surface generally parallel to said blade and a second portion having a second flat bearing surface generally parallel to said first bearing surface in spaced relation and said slide member having flat parallel side surfaces closely received between said bearing surfaces preventing pitching of said blade.

* * * * *